US009508510B2

(12) United States Patent
Blanchet et al.

(10) Patent No.: US 9,508,510 B2
(45) Date of Patent: Nov. 29, 2016

(54) MOBILE CONDUCTING UNIT FOR A BREAKER, INCLUDING A SPRING FOR ACCELERATING THE SEPARATION OF ARC CONTACTS

(71) Applicant: Alstom Technology Ltd., Baden (CH)

(72) Inventors: Guilhem Blanchet, Aix les Bains (FR); Laurent Rat-Patron, Mouxy (FR)

(73) Assignee: ALSTOM TECHNOLOGY LTD, Baden (CH)

( * ) Notice: Subject to any disclaimer, the term of this patent is extended or adjusted under 35 U.S.C. 154(b) by 91 days.

(21) Appl. No.: 14/363,473

(22) PCT Filed: Dec. 12, 2012

(86) PCT No.: PCT/EP2012/075172

§ 371 (c)(1),
(2) Date: Jun. 6, 2014

(87) PCT Pub. No.: WO2013/087669

PCT Pub. Date: Jun. 20, 2013

(65) Prior Publication Data

US 2014/0346147 A1 Nov. 27, 2014

(30) Foreign Application Priority Data

Dec. 14, 2011 (FR) ..... 11 61611

(51) Int. Cl.
*H01H 33/02* (2006.01)
*H01H 33/42* (2006.01)
(Continued)

(52) U.S. Cl.
CPC ..... *H01H 33/42* (2013.01); *H01H 33/36* (2013.01); *H01H 33/40* (2013.01); *H01H 33/46* (2013.01);
(Continued)

(58) Field of Classification Search
CPC ..... H01H 31/32; H01H 33/12
USPC ..... 200/401
See application file for complete search history.

(56) References Cited

U.S. PATENT DOCUMENTS 4,419,553 A * 12/1983 Ohshita ..... H01H 33/666 200/401
5,237,137 A * 8/1993 Lorenz ..... H01H 33/122 218/14

(Continued)

FOREIGN PATENT DOCUMENTS

DE 102006001241 A1 7/2007
FR 2547107 A1 12/1984

OTHER PUBLICATIONS

International Search Report for PCT/EP2012/075172 dated Mar. 28, 2013.

(Continued)

*Primary Examiner* — Renee Luebke
*Assistant Examiner* — Ahmed Saeed
(74) *Attorney, Agent, or Firm* — Pearne & Gordon LLP

(57) ABSTRACT

A disconnector (1) including a movable conductive unit (6) comprising a main electrically conductive body (9) has a main contact (4*b*) as well as an arcing contact (5*b*). According to the invention, the unit (6) further comprises a secondary body (14) mounted to move in sliding relatively to the main body (9) along a movement direction (11) of the unit (6), the secondary body (14) being designed to be connected to a connection point (22) of a drive device of the unit (6), the unit further comprising resilient return means (16) interposed between the bodies (9, 14), the switchgear being designed so that during an opening operation the resilient return means (16) can firstly store energy as a result of the secondary body (14) moving relative to the main body (9), and can then release the stored energy in order to cause the main body (9) to accelerate.

10 Claims, 13 Drawing Sheets

(51) Int. Cl.

| | |
|---|---|
| ***H01H 33/40*** | (2006.01) |
| ***H01H 33/36*** | (2006.01) |
| ***H01H 33/46*** | (2006.01) |
| *H01H 1/38* | (2006.01) |
| *H01H 3/30* | (2006.01) |
| *H01H 3/46* | (2006.01) |
| *H01H 31/32* | (2006.01) |
| *H01H 33/12* | (2006.01) |

(52) U.S. Cl.

CPC ..... *H01H 1/385* (2013.01); *H01H 3/3052* (2013.01); *H01H 3/46* (2013.01); *H01H 31/32* (2013.01); *H01H 33/12* (2013.01); *H01H 2235/01* (2013.01)

(56) References Cited

U.S. PATENT DOCUMENTS

| | | | | |
|---|---|---|---|---|
| 6,284,993 | B1 * | 9/2001 | Ledru | H01H 33/166 218/143 |
| 6,466,420 | B1 | 10/2002 | Chuniaud | |
| 2009/0071809 | A1 * | 3/2009 | Allaire | H01H 3/42 200/337 |

OTHER PUBLICATIONS

French Search Report for FR 1161611 dated Aug. 29, 2012.
Written Opinion for PCT/EP2012/075172.

* cited by examiner

MOBILE CONDUCTING UNIT FOR A BREAKER, INCLUDING A SPRING FOR ACCELERATING THE SEPARATION OF ARC CONTACTS

TECHNICAL FIELD

The present invention relates to the field of switchgear, in particular of the disconnector or grounding switch type, preferably high-voltage switchgear.

More precisely, the invention relates to an electrically conductive unit of the switchgear, said unit being conventionally fitted with a main contact and with an arcing contact.

PRIOR ART

Conventionally, and in manner known to the person skilled in the art, the electrically conductive unit of switchgear of the disconnector or grounding switch type is moved in translation at a constant speed during each opening operation and during each closing operation.

During those repeatedly-performed operations, the conductive unit, which generally takes the form of a cylinder fitted with a main contact and with an arcing contact, is subjected to mechanical and electrical stresses that gradually cause it to deteriorate. That phenomenon is also observed on the other main contact and on the other arcing contact of the switchgear.

Those problems generate the creation of particles, of pollution, and of heat, and affect the lifetime of the switchgear.

In particular, during an opening operation, if the speed of the electrically conductive unit is too fast, it leads to mechanical wear of the main contacts. That might suggest reducing the speed of the electrically conductive unit, but doing so would result in the arcing contacts becoming worn.

In an attempt to resolve that problem, document FR 2 547 107 proposes switchgear with a stationary arcing contact coupled to a spring that makes it possible to accelerate the speed at which the two arcing contacts move apart on being separated. Nevertheless, the stationary arcing contact can no longer really be considered stationary, since it is mounted to slide on the stationary housing of the switchgear. In addition, conventional switchgear designs do not generally make it possible to monitor the zone of the stationary contact, so detecting potential faults in the spring is not practical. That would appear to be insurmountable, since undetected breaking of the spring would give rise to dangerous malfunctioning of the switchgear.

Finally, coupling of the spring to the stationary contact would require a significant increase in the bulkiness of that zone, which would result in a detrimental increase in the overall bulkiness of the switchgear, even though compactness is a criterion that is considered fundamental in current switchgear.

SUMMARY OF THE INVENTION

The object of the invention is therefore to provide a solution, at least in part, to the above-mentioned drawbacks that relate to embodiments of the prior art.

To do this, the invention provides switchgear, in particular a disconnector or a grounding switch, including an electrically conductive movable unit comprising an electrically conductive main body including both a main contact and an arcing contact.

According to the invention, said electrically conductive movable unit also comprises a secondary body mounted to move in sliding relative to said main body along a movement axis of said electrically conductive unit, said secondary body being designed to be connected to a connection point of a drive device of said electrically conductive unit, said electrically conductive unit further comprising resilient return means interposed between said main body and said secondary body, and said switchgear being designed so that during an opening operation, said resilient means can firstly store energy as a result of the secondary body moving relative to the main body, and can then release the stored energy in order to cause said main body to accelerate.

Thus, the invention is first of all characterized in that it makes it possible to vary the speed of the main body of the movable unit, during the same opening operation, by means of the acceleration caused by the release of energy of the resilient return means. Consequently, this controlled variation may be determined in such a manner as to limit as far as possible mechanical and electrical wear of the electrically conductive unit. In this respect, the release of energy preferably begins after the permanent contacts have separated, and while the electrical arcing contacts are separating, i.e. it begins at the precise instant the arcing contacts separate, or before said instant, and it comes to an end after they have been separated. As a result, the speed of the arcing contact fitted on the electrically conductive unit is even higher during this critical stage of the opening operation, which limits damage due to electrical stresses.

Of course, the invention is also advantageous in that it allows the speed of the main body of the moving unit to be varied, while moving said connection point in translation at a constant speed. Consequently, the drive device of the conductive unit may advantageously include a motor operated at constant speed, even if a variable speed could be implemented without going beyond the ambit of the invention.

In addition, unlike the solution described in Document FR 2 547 107, the acceleration spring is not arranged on the stationary elements, but on the unit that includes the movable electrodes. Thus, by using this location that is specific to the present invention, it is possible to overcome the prior art problem of detecting a possible fault of the spring. It is indeed much easier to monitor for a possible break in the spring when it is on the movable conductive unit, than when it is close to the stationary elements.

Finally, the proposed solution reduces the overall bulkiness of switchgear compared with the prior art. Indeed, in the prior art, the modifications to the stationary contact to make it movable to a small extent lead to a significant increase in size, in particular for providing guidance for said contact in translation. However, when the accelerated element is arranged on the electrodes or movable conductors, on the conductive unit itself, the impact on size is considerably lower because that unit is already of large size, in particular having a length that is substantial in order to provide guidance in translation. This large size may be advantageously used to incorporate said secondary body and the resilient return means, without too much impact on the overall size, or even without any impact on said size.

Preferably, the switchgear includes abutment means making it possible, during an opening operation, to block the movement in translation of said main body relative to a stationary body of the switchgear, said secondary body being fitted with unlocking means designed to release said abutment means after said secondary body has been moved through a predetermined distance relative to the main body.

Preferably, said resilient return means include at least one compression or traction spring.

Preferably, said abutment means are arranged on a stationary body of the switchgear and on the main body of the electrically conductive movable unit.

The switchgear could present resilient return means having a function that is similar to that described above, with the aim of accelerating the contacts during a specific stage of the closing operation. By way of example, that could be performed by replacing the compression spring with a traction spring. Therefore, even if a solution with a plurality of springs is envisaged, it is still possible to use the same spring to ensure the required acceleration during opening and closing, respectively after the spring has been compressed and after it has been tensioned, or vice versa.

Preferably, the switchgear also comprises a drive device for driving said mobile unit, said device comprising a rotary input shaft and an output member including said connection point for connection to said electrically conductive unit, said connection point being movable in translation along the movement axis of said electrically conductive unit. In addition, said drive device comprises a mechanical system for transmitting movement between said connection point and said rotary input shaft, said mechanical system being designed in such a manner, during an opening operation and/or during a closing operation of the switchgear, it obtains a variable speed for the connection point during rotation at constant angular velocity of said rotary input shaft.

Nevertheless, any conventional drive device could be applied, without going beyond the ambit of the invention.

However, the particular design as described above departs from conventional drive devices of the prior art by providing for the connection point to move in translation at a constant speed during an opening operation and during a closing operation of the switchgear. In this example, the mechanical system makes it possible to effectively vary the speed the connection point moves in translation during one and/or the other of these operations. Consequently, this controlled variation may be determined in such a manner as to limit as far as possible mechanical and electrical wear of the electrically conductive unit. For the opening operation, this possible variation is added to the specific variation of the present invention, which variation is obtained by the main body of the movable unit being accelerated by said resilient return means.

By way of example, during the initial stage of an opening operation, the speed of the electrically conductive unit may be slow, until the main contacts have separated so as to limit mechanical wear thereof, then said speed may be increased in order to limit electrical wear of the arcing contacts.

In addition, during a closing operation, it may be advantageous to begin by moving slowly so as to avoid mechanical wear, and then to accelerate in order to limit electrical wear of the arcing contacts. Speed could also be limited during mutual engagement of the main contacts, after the arcing contacts have been put into contact.

In more general manner, concerning electrical stresses, the variation in the speed of the output member may be adapted in order to limit as far as possible the harmful effects of induced currents, of capacitive currents, of busbar transfers, and of short-circuit closing currents.

In any event, the way speed varies during each opening and closing operation may be determined by the person skilled in the art, as a function of the requirements and constraints encountered. It suffices to adapt the design of the mechanical transmission system, which, by definition is a mechanical solution that is easy to implement, reliable and inexpensive, in contrast, for example, to using a variable speed drive by controlling the frequency of the stator current of the electric motor. Nevertheless, that solution could be used, without going beyond the ambit of the invention.

As mentioned above, the variation in the speed in translation of the output member is obtained with the input shaft rotating at a constant angular velocity, as can easily be achieved by means of a conventional electric motor. Nevertheless, variable angular speed could be applied to the input shaft. By way of example, it is observed that the shaft may be connected directly or indirectly to the electric drive motor, or may even constitute the output shaft of said motor. Finally, in the event of the motor breaking down, the rotary input shaft may be actuated manually by a crank, as is already known to the person skilled in the art. During said actuation, the operator benefits advantageously from the effect of the speed being geared down or up by said specific transmission system.

The mechanical transmission system therefore preferably takes the form of a positive action link between the rotary input shaft and the output member including the connection point. The term "positive action" means that a both-way link exists between said rotary input shaft and said output member, in particular implying that in any position, the connection point has a corresponding angular position of the input shaft, and vice versa, and this is true at any point between the two end positions.

Preferably, said mechanical system comprises at least two elements, each provided with a groove and a peg-forming member housed to move in the groove of the other one of the two elements. Each element therefore forms a kind of cam co-operating with its associated member, which member performs a function that can be likened to that of cam follower. This technology has been found to be particularly reliable and easy to implement. Naturally, the number, the disposition, and the shape of the elements, of the grooves, and of the peg-forming members may be modulated as a function of desired variations in speed.

Preferably, the mechanical system is designed so that either of the two elements is driven by the other element takes by pressing one of its peg-forming members into the bottom of its associated groove, and by simultaneously moving the other peg-forming member into its associated groove. Even more preferably, provision is made for the driving element of the transmission to be the peg-forming member bearing into the bottom of its associated groove, the simultaneous movement of the other peg-forming member in its associated groove being used more to maintain a desired orientation of the element(s) present.

Preferably, the mechanical system is designed so that during an opening operation and/or during a closing operation of the switchgear, each peg-forming member passes at least once from the configuration in which it presses into the bottom of its associated groove to the configuration in which it moves in its associated groove, or vice versa. This change in configuration is naturally conducive to obtaining a change in speed of the output member. Preferably, these changes take place simultaneously, i.e. the instant at which one of the two peg-forming members leaves the bottom of its associated groove corresponds to the instant at which the other member enters into contact with the bottom of its associated groove.

Preferably, the mechanical system is designed so that during an opening operation and/or during a closing operation of the switchgear, the two peg-forming members describe two respective concentric circularly arcuate trajectories centered on an axis of said rotary input shaft. Once more, this is naturally conducive to obtaining a change in the linear speed of the output member, since by being situated at different distances from the axis of the input shaft, the two pegs necessarily present distinct linear speeds during rotation of said input shaft.

Preferably, one of the two elements of the mechanical transmission system is constrained to rotate with said rotary input shaft, and the other one of the two elements has a connecting rod on which said connection point is located. Nevertheless, similar intermediate elements could be arranged between said two elements, as mentioned above, without going beyond the ambit of the invention.

Preferably, the switchgear includes an electric motor driving the rotary input shaft of the drive device.

Other advantages and characteristics of the invention appear in the detailed non-limiting description given below.

BRIEF DESCRIPTION OF THE DRAWINGS

This description is made with reference to the accompanying drawings in which.

DETAILED DESCRIPTION OF PARTICULAR EMBODIMENTS

Figure 1:
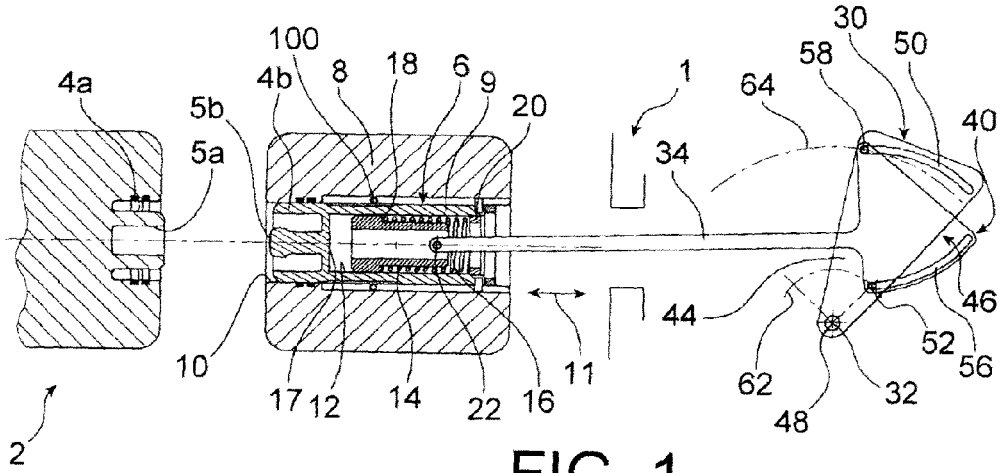
FIG. 1 shows a diagrammatic side view of a portion of a disconnector in a preferred embodiment of the present invention.
Figure 2:
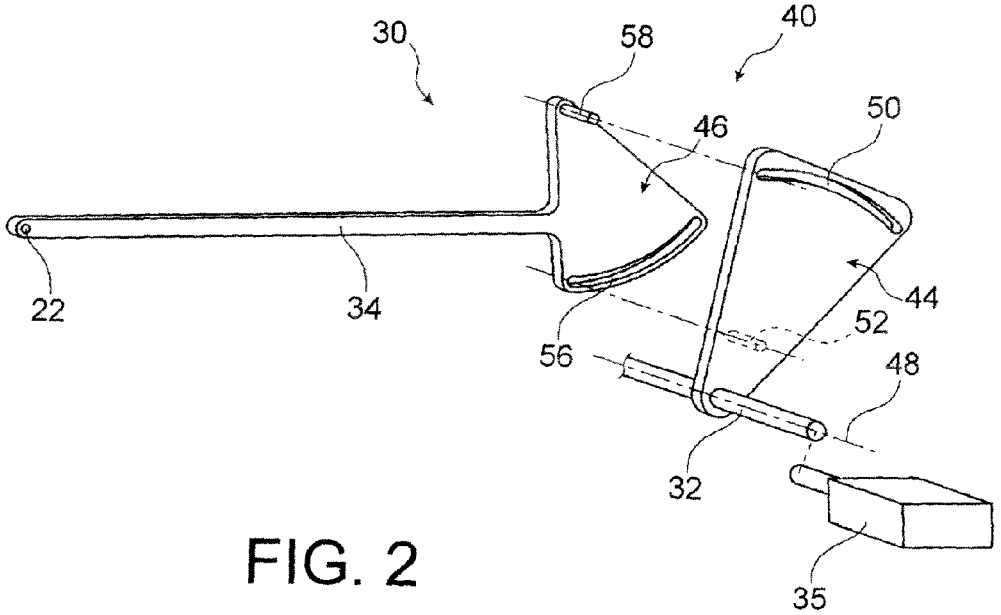
FIG. 2 shows an exploded perspective view of the drive device fitted on the disconnector of FIG. 1.

Firstly, FIGS. 1 and 2, show a portion of a disconnector in a preferred embodiment of the invention, said disconnector possibly being a grounding switch, preferably a high-voltage grounding switch.

The disconnector 1 comprises an arc-control chamber 2 shown only in part, enclosed in an enclosure containing an insulating gas such as $SF_6$ or any other gaseous mixture known to be appropriate. The chamber 2 encloses a stationary main contact 4*a*, as well as a stationary arcing contact 5*a*, situated radially towards the inside relative to the main contact 4*a*. It also encloses an electrically conductive unit 6, that is electrically connected to a stationary body 8 in which it is movable in translation, along a movement axis represented by the double-headed arrow 11. This unit 6 presents an end fitted with a movable main contact 4*b*, and with a movable arcing contact 5*b*, for co-operating with the above-mentioned contacts 4*a*, 5*a*.

The unit 6 takes on the overall shape of a cylinder that is movable in sliding, like the piston of an actuator, in a cylindrical housing 10 of the body 8. It comprises a main, electrically conductive body 9 forming an outer body, and incorporating the main contact 4*b* as well as the arcing contact 5*b*. Inside said main body 9 a through bore 12 is made that is oriented along the axis 11, and that houses a slidable secondary body 14. Thus, the secondary body 14 is mounted to move in sliding relative to the main body 9 along the movement axis 11.

In addition, the electrically conductive unit 6 includes resilient return means such as a compression spring 16, forcing the secondary body 14 to move towards a first end position relative to the main body, corresponding to the position in which it is situated as close as possible to the stationary main contact 4*a*. This first position, towards which the spring 16 tends to urge the secondary body 14, also corresponds to a position in which said body 14 is situated in the end wall 17 of the through bore 12.

To do this, the spring 16 arranged about the secondary body 14 bears at one of its ends against a collar 18 of said body, and bears at its other end against a ring 20 mounted in stationary manner in the through bore 12 of the body 9.

Thus, when the secondary body 14 moves along the axis 11 in the opening direction, causing the electrical contacts to move apart, it transmits this movement to the main body 9 incorporating the contacts by means of the reaction from the compression spring on the ring 20. Conversely, when the secondary body 14 moves along the axis 11 in the closing direction, causing the electrical contacts to move together, it transmits this movement to the main body 9 by pressing its end against the end wall 17 of the bore 12.

In order to set the secondary body into movement, so as to implement the opening and closing operations of the disconnector, said secondary body 14 is connected to a connection point 22 of a drive device 30 a preferred embodiment of which is described below. Nevertheless, any other conventional embodiment may be used in order to drive the connection point 22, without going beyond the ambit of the invention.

The device 30 comprises a rotary input shaft 32, that is substantially orthogonal to the sliding axis 11 of the movable unit 6. As shown diagrammatically in FIG. 2, the rotary input shaft 32 is designed to be driven by an electric motor 35, in direct or indirect manner, preferably at a constant angular velocity for each of the opening and closing operations.

The drive device 30 also comprises an output member 34 in the form of a connecting rod, one end of which includes the connection point 22 to the secondary body 14, and is movable in translation along the axis 11. In addition, the connecting rod 34 is substantially parallel to said axis 11, and is designed to stay parallel during the opening and closing operations, even if oscillations of a few degrees may occur around the connection point 22 forming a pivot connection, without going beyond the ambit of the invention.

The device 30 includes a mechanical system 40 for transmitting movement between the connecting rod 34 and the rotary input shaft 32, this mechanical system 30 being generally designed in such a manner as to obtain a variable speed in translation for the connection point 22 during rotation of the rotary input shaft 32 at a constant angular velocity, both during an opening operation and during a closing operation of the switchgear. This variable speed in translation is defined along the axis 11, relative to the stationary body 8 of the disconnector.

In this example, the mechanical system 40 comprises two elements 44, 46, the first element 44 being constrained to rotate with the shaft 32, and the second element 46 being secured to the connecting rod 34. They may each be generally triangular in shape, being disposed in parallel and facing each other, orthogonal to the axis 48 of the shaft 32 and parallel to the axis 11.

The first element 44 presents a groove 50 of circularly arcuate shape, arranged in the proximity of the side remote from the vertex receiving the shaft 32. This groove 50 may be made in one of the faces of the element 44, or alternatively it may be a through groove. In addition, the first element 44 comprises a peg-forming member 52, projecting from one of the faces towards the second element 46, parallel to the axis 48. The peg 52 is situated between the groove 50 and said same axis 48 of the rotary input shaft 32.

In analogous manner, the second element 46 presents a groove 56 of circularly arcuate shape, arranged in the proximity of the side remote from the vertex carrying a peg-forming member 58. This groove 56 may likewise be made in one of the faces of the element 46, or alternatively it may be a through groove. In addition, the peg 58 projects from one of the faces towards the first element 44, parallel to the axis 48.

In the assembled state, the peg 52 is housed to move in sliding in the groove 56, while the peg 58 is housed to move in sliding in the groove 50. Each element 44, 46 therefore forms a kind of cam co-operating with its associated member 58, 52, which member performs a function that can be likened to that of a cam follower.

With this configuration, provision is made so that the driving of either one of the two elements 44, 46 by the other element takes place by one of the peg-forming members 52, 58 pressing into the bottom of its associated groove, and by simultaneously moving the other peg-forming member in its associated groove. More precisely, provision is made for the driving element of the transmission to press into the bottom of its associated groove, with the simultaneous movement of the other peg-forming member in its associated groove being further used to maintain a substantially constant orientation for the connecting rod 34 carried in stationary manner by the element 46, namely an orientation that is substantially parallel to the sliding axis 11. In this respect, it is noted that the second element 46 also preserves a substantially identical orientation during its movement as observed during opening and closing operations.

Finally, it is indicated that the design of the mechanical transmission system 40 is such that during an opening operation and during a closing operation of the switchgear, the two peg-forming members 52, 58 describe two respective concentric circularly arcuate trajectories 62, 64 that are centered on the axis 48. The positive action mechanical system 40 between the rotary input shaft 32 and the connecting rod 34, is such that the arcuate trajectories are identical for the opening and closing stages.

In FIG. 1, the disconnector 1 is shown in the open position, in which the movable unit 6 is at a distance from the stationary contacts 4*a*, 4*b*. In this state, the peg 52 presses against the bottom of the groove 56, at an end thereof referred to as the anti-clockwise end about the axis 48. In addition, the peg 58 presses against the bottom of the groove 50, at an end thereof also referred to as the anti-clockwise end about the axis 48.

Figure 3A:
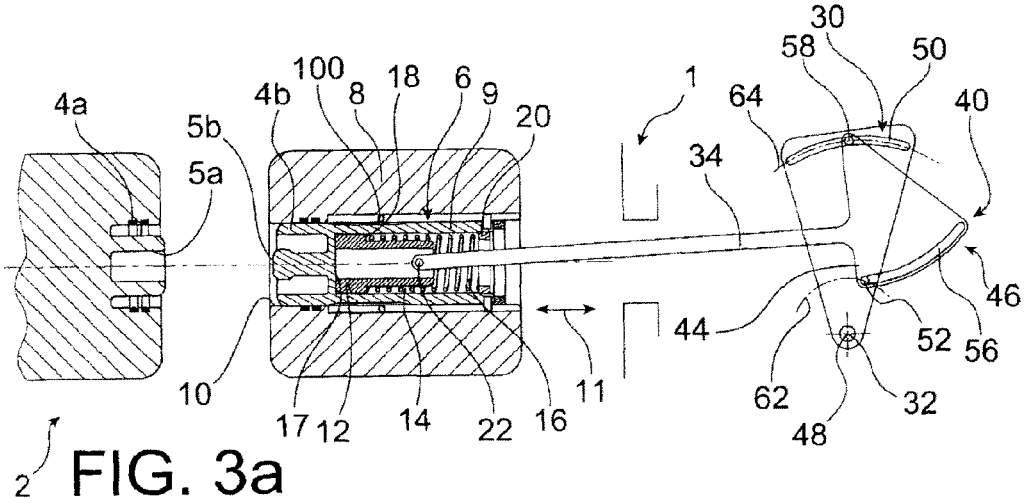
FIGS. 3*a* to 3*c* show different configurations of the disconnector adopted successively during a closing operation.

In reference to FIGS. 3*a* to 4, a closing operation of the disconnector is described below, which operation is initiated from the open position shown in FIG. 1. This operation is implemented by the electric motor of the disconnector rotating the input shaft 32 at a constant speed.

The shaft 32 rotates in an anti-clockwise direction. As soon as rotation begins, the first element 44 turns in the same direction, and drives the second element 46 by pressing the peg 52 into the groove 56. At the same time, the peg 58 moves in the groove 50, towards the other end of said groove, referred to as the clockwise end about the axis 48. This movement of the peg 58 in the groove 50 makes it possible, in this example, essentially to preserve a substantially identical orientation for the second element 46 in its movement plane while it is being driven by the peg 52, so as to preserve a substantially identical orientation for the connecting rod 34. Said rod therefore moves along its axis, possibly being subjected to small angular oscillations about the connection point 22.

During the initial stage of the closing operation, movement of the connection point 22 in the axis 11 towards the stationary contacts 4*a*, 5*a* drives only movement of the secondary body 14 in the bore 12, until it makes contact with the end wall 17. This state is shown in FIG. 3*a* and corresponds to point P1 on the graph shown in FIG. 4, showing that movement of the main body 9 of the electrically conductive unit 6, represented diagrammatically by the continuous-line curve, has not yet begun. During said initial closing stage, the spring 16 decompresses until the body 14 makes contact with the end wall 17. Alternatively, provision could be made for the configuration shown in FIG. 3*a* to be adopted in the open position. The closing operation thus begins with the secondary body 14 in contact with the end wall 17 of the bore 12.

Rotation of the shaft 32 continues at the same angular speed, still by pressing the peg 52 into the groove 56, which drives simultaneous movement of the main body 9 and of the secondary body 14 of the movable unit 6. Since the peg 52 is moving along the circularly arcuate trajectory 62, its linear speed is constant, which encourages the connection point 22 to move at a constant linear speed in translation until the configuration of the mechanical system 30 is inverted. Here, "inversion" refers to the fact that the motor element for driving movement of the second element 46 via the first element 44 is no longer pressing against the peg 52 in the groove 56, but is pressing against the other peg 58 in the bottom of the groove 50.

Figure 3B:
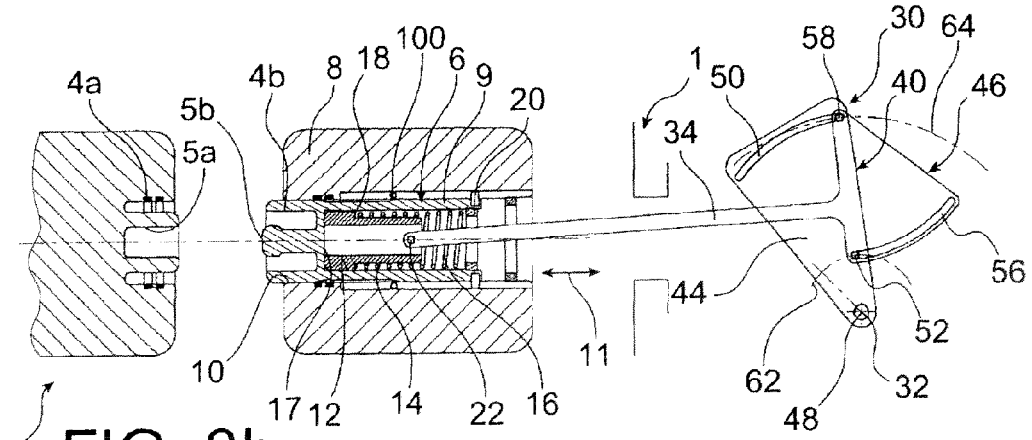
Figure 4:
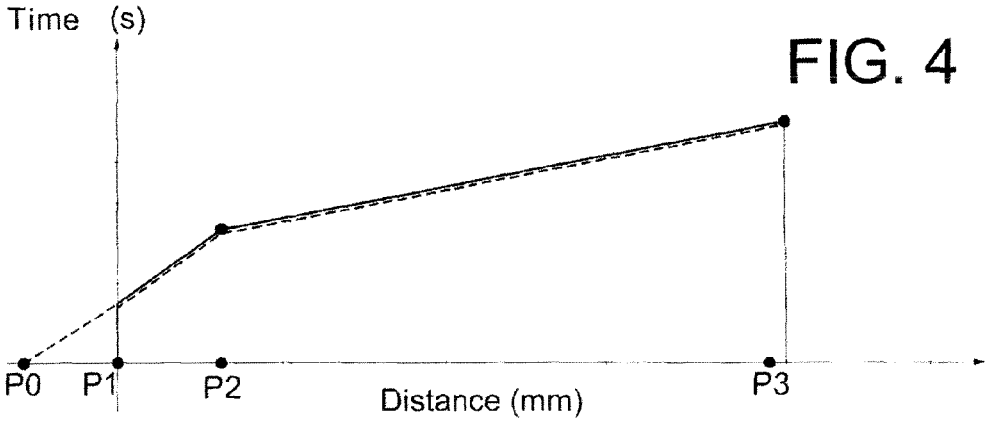
FIG. 4 is a graph diagrammatically showing the movement of certain elements of the disconnector during the closing operation, the dashed-line curve corresponding to the movement of the connection point of the drive device, and the continuous-line curve corresponding to the movement of the main body of the electrically conductive unit of the disconnector.

This instant at which the configuration is inverted, corresponding to point P2 on the graph shown in FIG. 4, is shown in FIG. 3*b*. During said closing stage, the first element 44 continues to turn in the same anti-clockwise direction, and drives the second element 46 by pressing the peg 58 into the groove 50. At the same time, the peg 52 moves in the groove 56, towards the other end of said groove, referred to as the clockwise end about the axis 48. Again, in this example, the movement of the peg 52 in the groove 56 makes it possible essentially to preserve a substantially identical orientation of the second element 46 in its movement plane while it is being driven by the groove 50, so as to preserve a substantially identical orientation for the connecting rod 34.

Figure 3C:
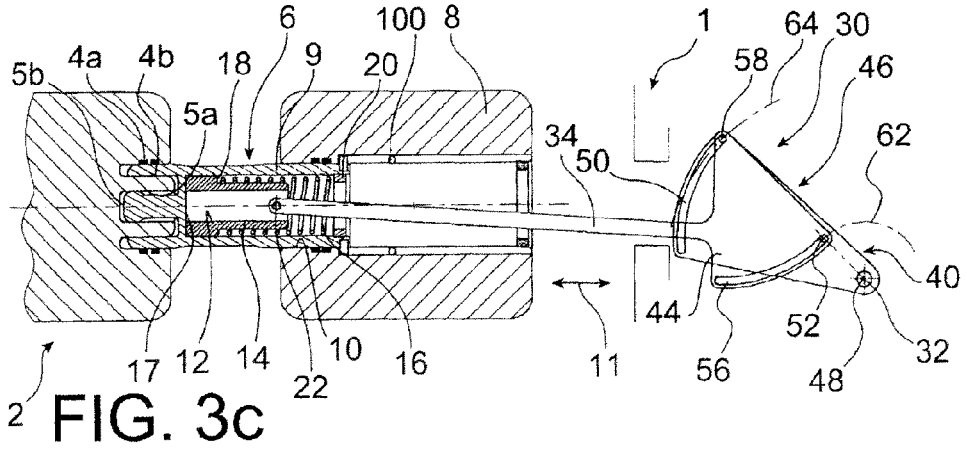

Like the trajectory 62 of the peg 52, the circularly arcuate trajectory 64 of the peg 58 is centered on the axis 48 and it presents a radius that is greater than that of said trajectory 62, which results in an accelerated speed in translation of the connection point 22, after passing through point P2. In addition, this speed is preferably substantially constant until reaching the end of the closing operation as shown diagrammatically in FIG. 3*c*, i.e. when the connection point 22 reaches point P3. FIG. 3*c* therefore shows the disconnector in the closed position, in which the electrical contacts 4*a* & 4*b* and 5*a* & 5*b* co-operate in pairs. In this closed state, the peg 52 presses into the bottom of the groove 56, at its clockwise end about the axis 48, and the peg 58 presses into the bottom of the groove 50, also at its clockwise end about the axis 48.

With this operation, the slower speed applied on starting the closing operation makes it possible to limit mechanical wear of the elements moving relative to one another, whereas the faster speed at the end of the closing operation makes it possible to limit electrical wear of the arcing contacts 5*a* & 5*b*.

Figure 5A:
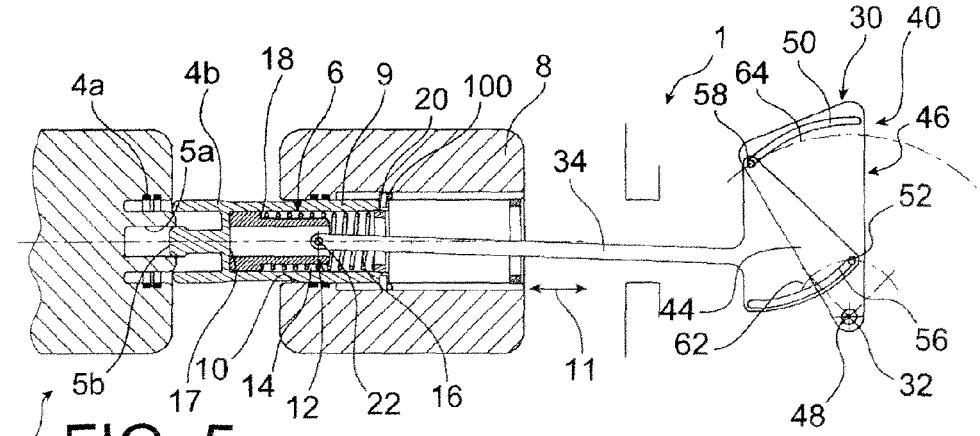
FIGS. 5*a* to 5*e* show different configurations the disconnector adopts successively during an opening operation.
Figure 5B:
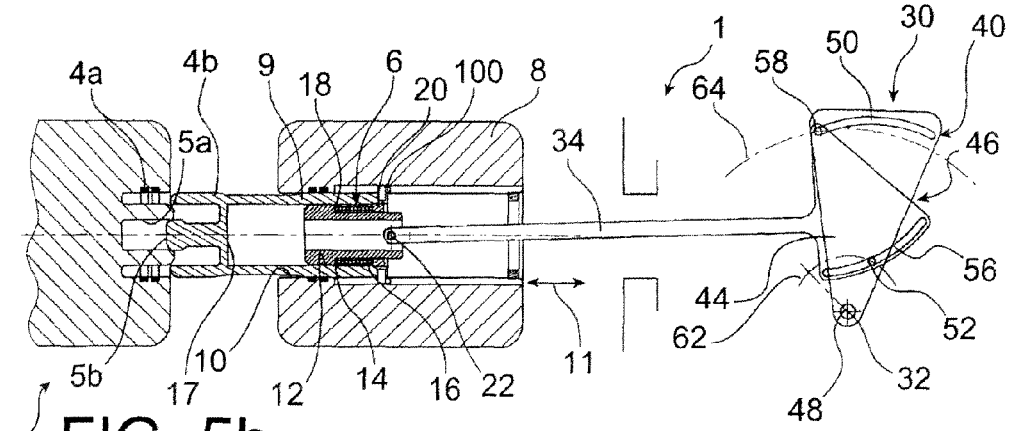
Figure 5C:
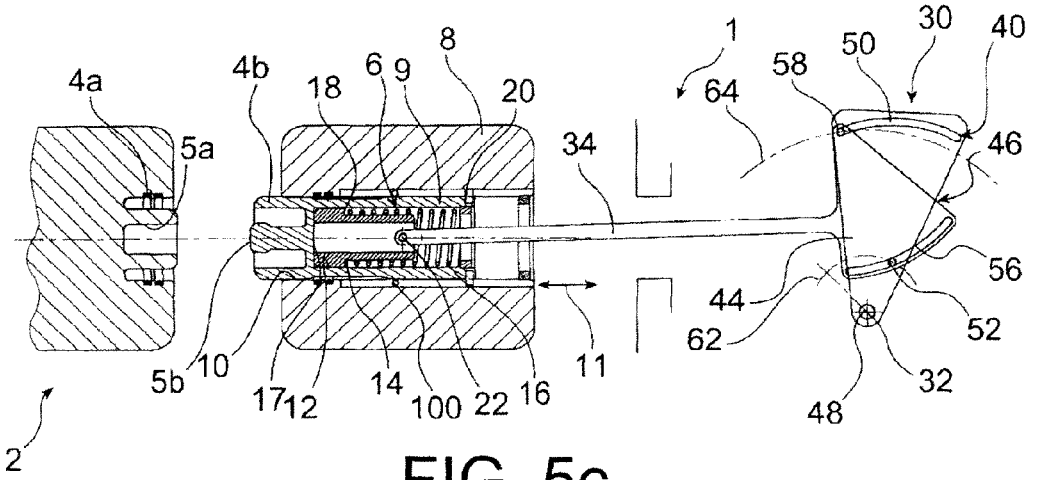
Figure 5D:
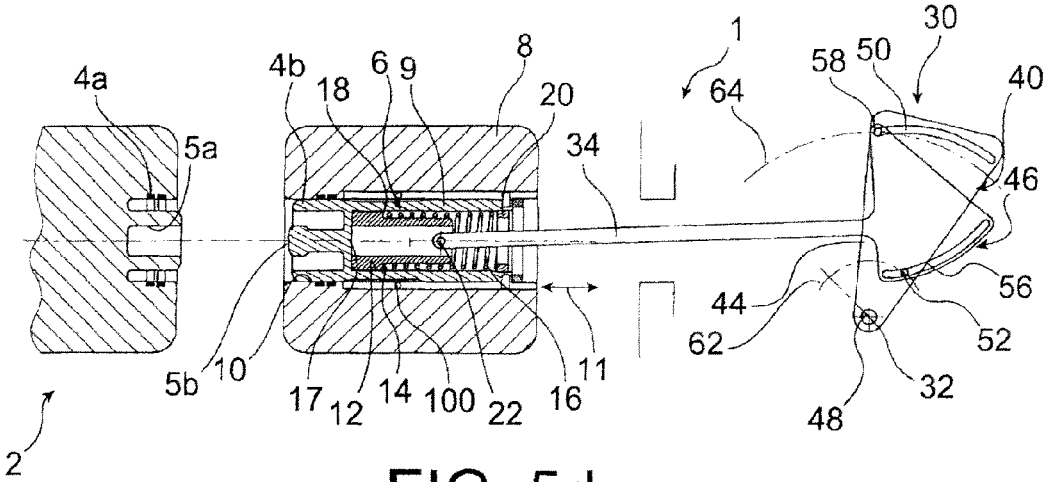
Figure 5E:
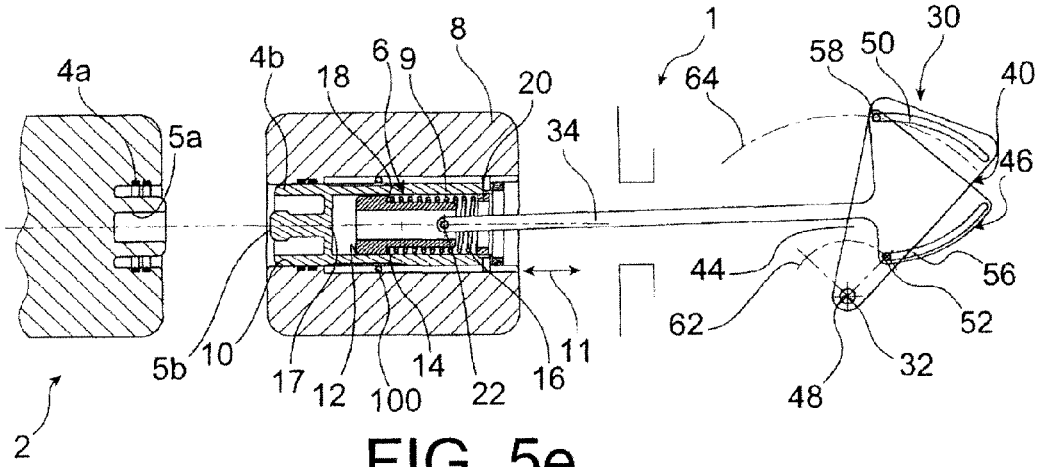
Figure 6:
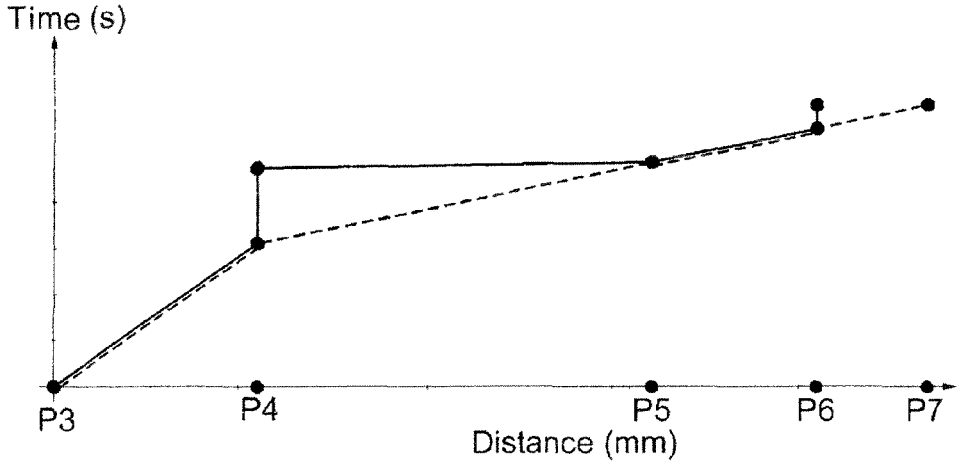
FIG. 6 is a graph diagrammatically showing the movement of certain elements of the disconnector during the opening operation, the dashed-line curve corresponding to the movement of the connection point of the drive device, and the continuous-line curve corresponding to the movement of the main body of the electrically conductive unit of the disconnector.

With reference to FIGS. 5*a* to 6, an opening operation of the disconnector is described below, which operation is initiated from the closed position shown in FIG. 3*c*. This operation is implemented by the electric motor of the disconnector rotating the input shaft 32 at a constant speed.

The shaft 32 rotates in a clockwise direction. As soon as rotation begins, the first element 44 turns in the same direction, and drives the second element 46 by pressing the peg 52 into the groove 56. At the same time, the peg 58 moves in the groove 50, towards the other end of said groove, referred to as the anti-clockwise end about the axis 48. Again, in this example, the movement of the peg 58 in the groove 50 makes it possible essentially to preserve a substantially identical orientation for the second element 46 in its movement plane while it is being driven by the peg 52, so as to preserve a substantially identical orientation for the connecting rod 34. Said rod therefore moves along its axis, possibly being subjected to small angular oscillations about the connection point 22.

During the initial stage of the opening operation, movement of the connection point 22 in the axis 11 in the opposite direction to that of the stationary contacts 4*a*, 5*a*, drives simultaneously the secondary body 14 and the main body 9 via the spring 16, as shown in FIG. 5*a* and in the graph of FIG. 6, between points P3 and P4. During this initial stage, the linear speed of the movable elements is relatively slow and constant, which makes it possible to limit mechanical wear of the disconnector. At the instant at which the connection point 22 reaches point P4, i.e. the instant shown in FIG. 5*a*, the main contacts 4*a*, 4*b* have been separated, but the arcing contacts 5*a*, 5*b* are still making contact. It is at this instant that the configuration of the mechanical system 40 is inverted. Here, "inversion" refers to the fact that the motor element for driving movement of the second element 46 via the first element 44 is no longer pressing against the peg 52 in the groove 56, but is pressing against the other peg 58 in the bottom of the groove 50.

This inversion leads to the linear speed in translation of the connection point 22 accelerating with this speed then being maintained substantially constant until reaching the open position shown in FIG. 5*e*, which position corresponds to point P7 of the graph of FIG. 6, at which point the drive device adopts a configuration that is identical to that adopted at point P0 of the graph of FIG. 4.

At the moment following the instant of the change of linear speed of the connection point 22, the secondary body 14 is driven by said connection point and the spring 16 is compressed strongly, since the main body 9 is temporarily blocked in translation relative to the stationary body 8, by abutment means shown diagrammatically by the element 100. This feature is unique to the present invention, and several possible designs are described in detail below.

The main body 9 therefore remains in position for a moment, without being driven by the secondary body 14 that continues its stroke.

This thus leads to the spring 16 storing energy as a result of the secondary body 14 moving relative to the main body 9 towards a second end position opposite from the above-mentioned first end position. FIG. 5*b* shows the state of the device 30 with the spring 16 strongly compressed with the arcing contacts still making contact. In this second position, after the body 14 has been moved a determined distance relative to the body 9, it unlocks the abutment means 100 in a manner that is also described below. This causes the main body fitted with the movable contacts 4*b*, 5*b*, to be released so that it is thus moved at a very considerable speed along the axis 11, under the effect of the release of energy from the spring 16, until the moment when it comes into abutment against the secondary body 14 that is still moving and occupying the point P5, as shown in FIG. 5*c*.

After this contact has been made with the end wall 17 of the bore 12, the two bodies 9, 14 are driven at substantially the same linear speed, until they reach the point P6 of the connection point 22. At that instant, the main body stops because it is in abutment on the stationary body 8, and the secondary body 14 continues its stroke until it reaches the point P7, corresponding to the instant at which the peg 52 in the bottom of the groove 56 presses against its anti-clockwise end about the axis 48. At this instant the disconnector is in the open state, identical to that shown in FIG. 1.

There follows a description of several specific examples of embodiments for the abutment means 100, which, it should be recalled, contribute during an opening operation to ensuring that the spring 16 can first store energy as a result of the secondary body 14 moving relative to the main body 9 that is blocked temporarily by said means 100, and can then release the stored energy in order to cause the main body 9 to accelerate.

Initially, with reference to FIGS. 7*a* to 7*e* and 8, there can be seen a first example in which the abutment means 100 comprise radial pins 102 received in corresponding orifices 104 made in the stationary body 8. The pins 102 are coupled to resilient return means of the spring type, urging them radially inwards in such a manner that they project into the housing 10.

The main body 9 includes longitudinal slots 106 at its portion situated remote from the contacts 4*b*, 5*b*, with the ends of the pins 102 sliding in said slots. More precisely, a pin 102 is received in each slot 106, which is made up of two portions of different widths, a portion 106*b* situated closer to the contacts being of smaller width than the other portion 106*a* into which it leads, as can be seen more clearly in FIG. 8. The place 108 at which the width narrows between the portions 106*a*, 106*b* of each slot 106 forms an integral portion of the abutment means 100, since it is designed to constitute an abutment for the pins 102 that are of a diameter that is greater than the width of the portion 106*b*.

The secondary body 14 is fitted with unlocking means 110 for unlocking the abutment means, which unlocking means may be likened to sliders carried in stationary manner by said body 14, and housed to slide in the portions 106*b* of the slots 106 of the main body. Each slider 110 may be chamfered so as to soften its entry into contact with its associated pin.

FIGS. 7*a* to 7*e* correspond respectively to FIGS. 3*c*, and 5*a* to 5*d* described above. Nevertheless, FIG. 7*e* may be considered as the final opening position, without going beyond the ambit of the invention. Alternatively, the point 22 may continue to move, thus driving the secondary body 14 a little relative to the main body 9, as described above with reference to FIG. 5*e*.

Thus, during initiation of the opening stage, the bodies 9 and 14 move together, and this results in the sliders 110 sliding in the portions 106*b* of the slots 106, and the pins 102 sliding in the portions 106*a* of said same slots. From an instant shown diagrammatically in FIG. 7*b*, the pins 102 come into abutment against the narrowed portions 108 of the slots, thus causing the abutment means to be activated. The main body 9 is thus stopped from moving in translation and is stationary relative to the body 8, whereas the secondary body 14 continues to be moved via its connection point 22. During this stage, the spring 16 is thus compressed between the two bodies 9, 14, which move relative to one another, as shown diagrammatically in FIG. 7*c*.

Figure 7A:
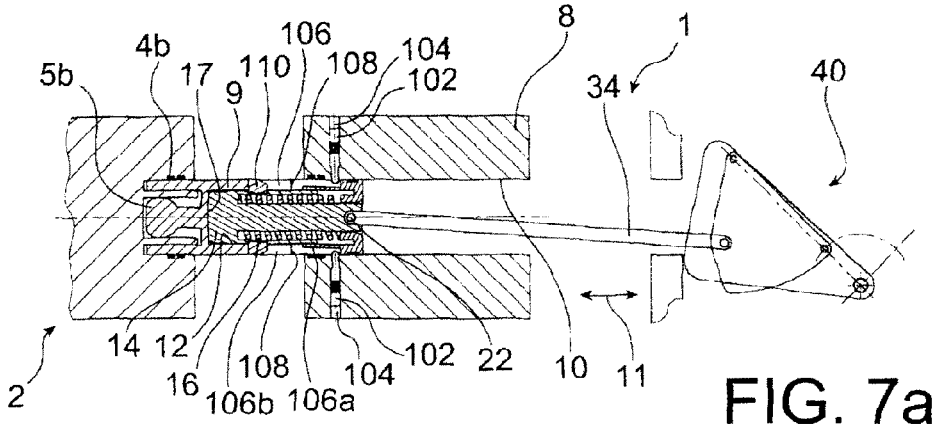
FIGS. 7*a* to 7*e* show different configurations the disconnector adopts successively during an opening operation, with the disconnector being in the form of another preferred embodiment of the invention.
Figure 7B:
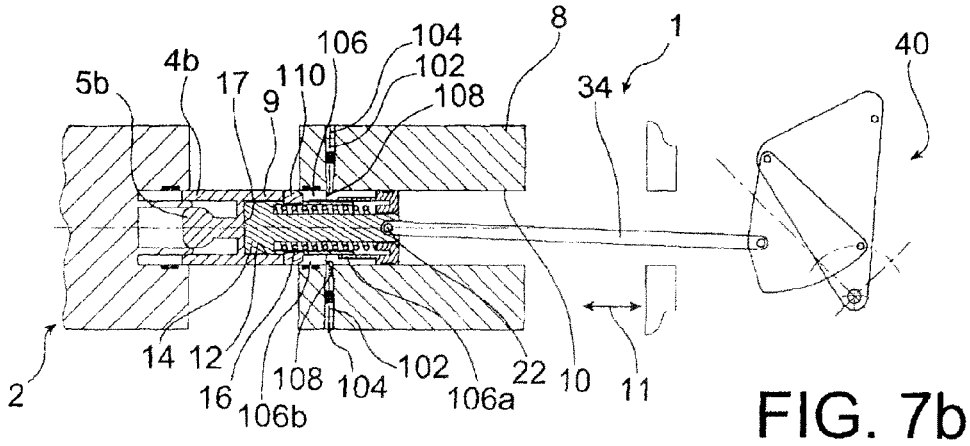
Figure 7C:
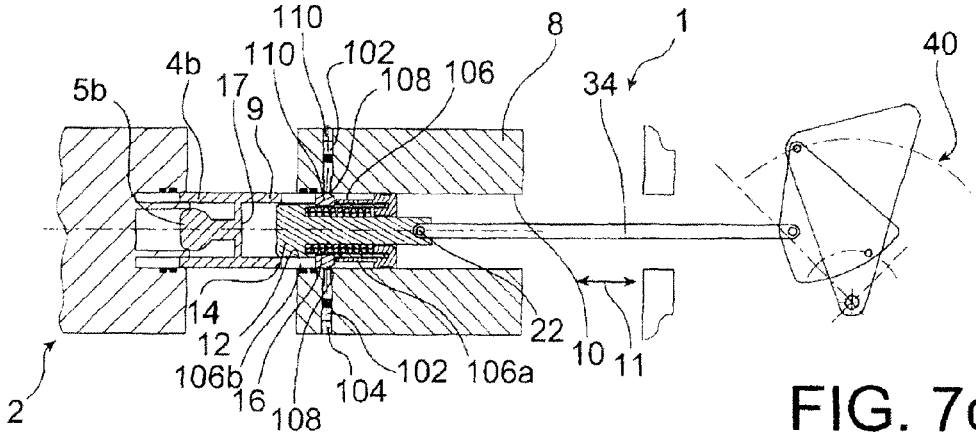
Figure 7D:
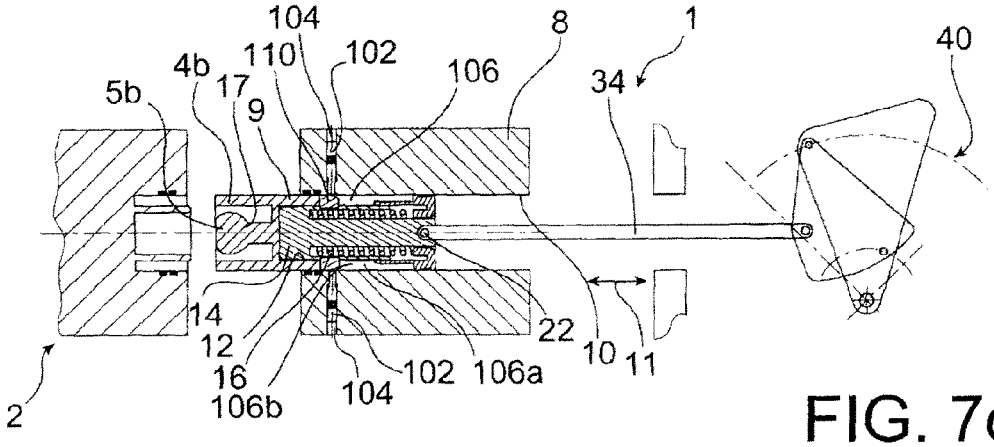
Figure 7E:
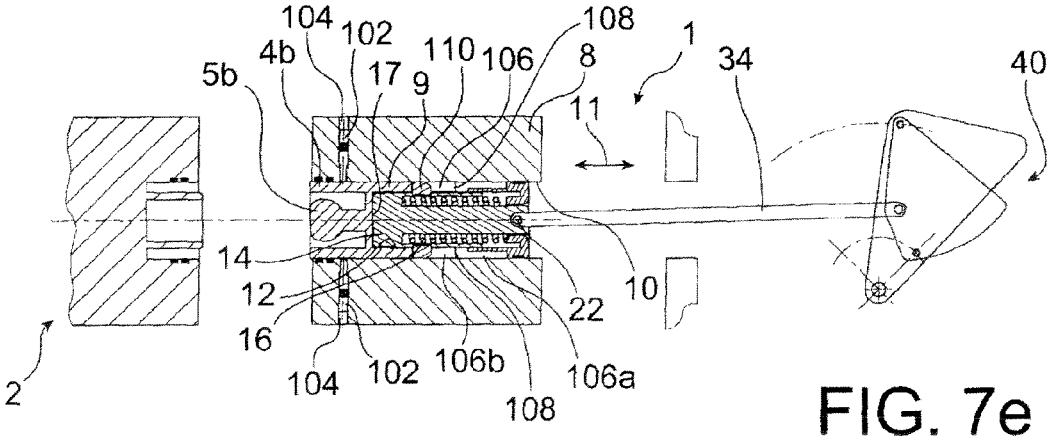
Figure 8:
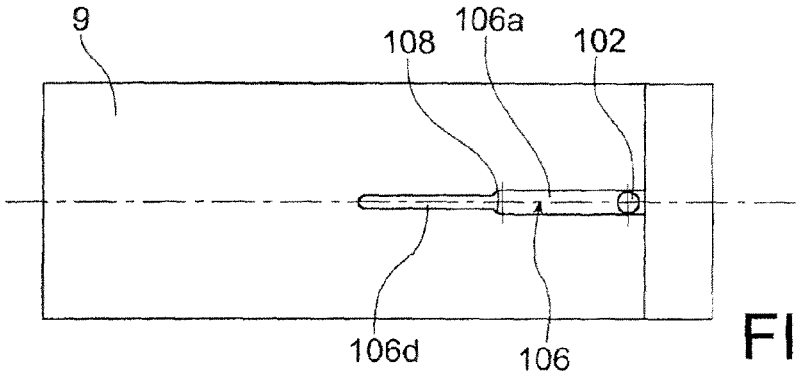
FIG. 8 shows the main body of the conductive unit of the disconnector shown in FIGS. 7*a* to 7*e;*

The same figure shows that the sliders 110 are designed to release the abutment means after the secondary body 14 has been moved relative to the main body 9 through a predetermined distance, at the end of which said sliders come into contact with the pins 102 and urge them radially outwards, opposing the return force exerted on said same pins. The main body is thus released from the pins that are driven into the stationary body 8 under the effect of the sliders, and the spring 16 then decompresses suddenly and causes the main body 9 to accelerate, with the end wall of its bore 17 then pressing against the secondary body 14, as shown in FIG. 7*d*. This acceleration is produced after separation of the main contacts and during separation of the arcing contacts, so as to limit electrical wear of said arcing contacts.

Then, opening takes place in a manner analogous to that described above, with the pins 102 pressing slidingly against the outer surface of the main body 9.

FIGS. 9*a* to 9*e* and 10, show a second example in which the abutment means 100 include radial pins 202 received in corresponding orifices 204 made in the end of the main body 9 situated opposite from the contacts 4*b*, 5*b*. The pins 202 are coupled to resilient return means of the spring type, urging them radially inwards. In addition, the stationary body 8 presents an inside member 8*a* of cylindrical shape or having a plurality of longitudinal tabs, the member 8*a* shown in FIG. 10 being housed inside the housing 10. The member 8*a* includes longitudinal slots 206 at its portion situated opposite from the contacts 4*b*, 5*b*, with the ends of the pins 202 being inserted radially into the slots from the outside to slide therein. More precisely, a pin 202 is received in each slot 206, which is made up of two portions of different widths, a portion 206*b* situated closer to the contacts being of greater width than the other portion 206*a* into which it leads, as can be seen more clearly in FIG. 10. The place 208 at which the width narrows between the portions 206*a*, 206*b* of each slot 206 forms an integral portion of the abutment means 100, since it is designed to constitute an abutment for the pins 202 that are of a diameter that is greater than the width of the portion 206*a*.

The secondary body 14 is fitted with unlocking means 210 for unlocking the abutment means, which unlocking means may be likened to sliders carried in stationary manner by said body 14, and which are able to slide in the portions 206*b* and 206*a* of the slots 206 of the stationary member 8*a*. Each runner 210 may be chamfered so as to soften its entry into contact with its associated pin.

FIGS. 9*a* to 9*e* correspond respectively to above-described FIGS. 7*a* to 7*e*. Again, FIG. 9*e* may be considered as the final opening position, without going beyond the ambit of the invention. Alternatively, the movement of the point 22 may be continued, thus driving the secondary body 14 a little relative to the main body 9, as described above with reference to FIG. 5*e*.

Thus, during initiation of the opening stage, the bodies 9 and 14 move together, and this results in the sliders 210 being inserted in the portions 206*b* of the slots 206 and sliding therealong, and also results in pins 202 sliding in the portions 206*a* of said same slots. From an instant shown diagrammatically in FIG. 9*b*, the pins 202 come into abutment against the narrowed portions 208 of the slots, thus causing the abutment means to be activated. The main body 9 is thus stopped in translation and is stationary relative to the body 8 and the inserted member 8*a*, whereas the secondary body 14 continues to be moved via its connection point 22. During this stage, the spring 16 is thus compressed between the two bodies 9, 14, which move relative to one another, as shown diagrammatically in FIG. 9*c*.

Figure 9A:
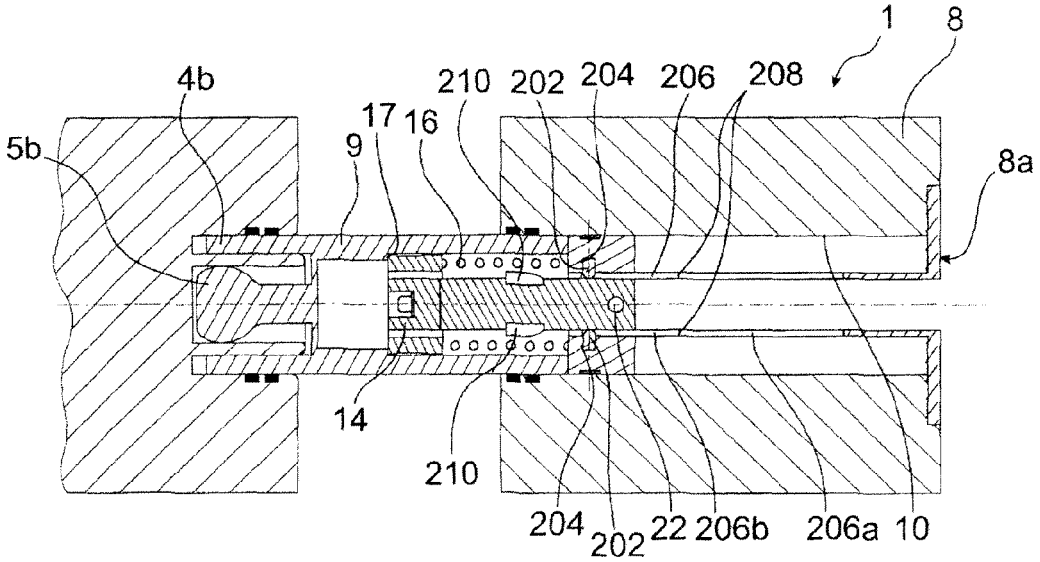
FIGS. 9*a* to 9*e* show different configurations the disconnector adopts successively during an opening operation, with the disconnector being in the form of another preferred embodiment of the invention.
Figure 9B:
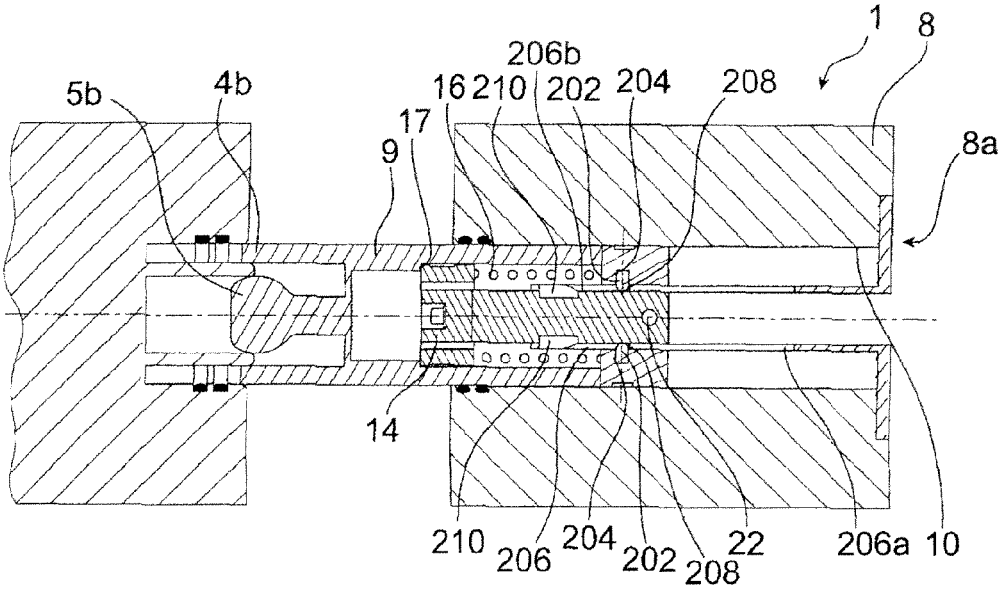
Figure 9C:
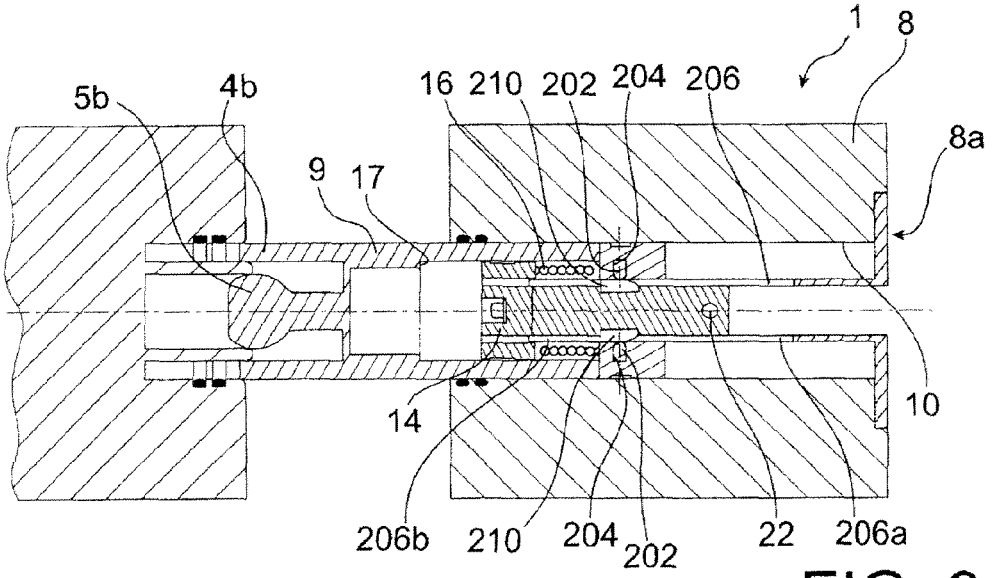
Figure 9D:
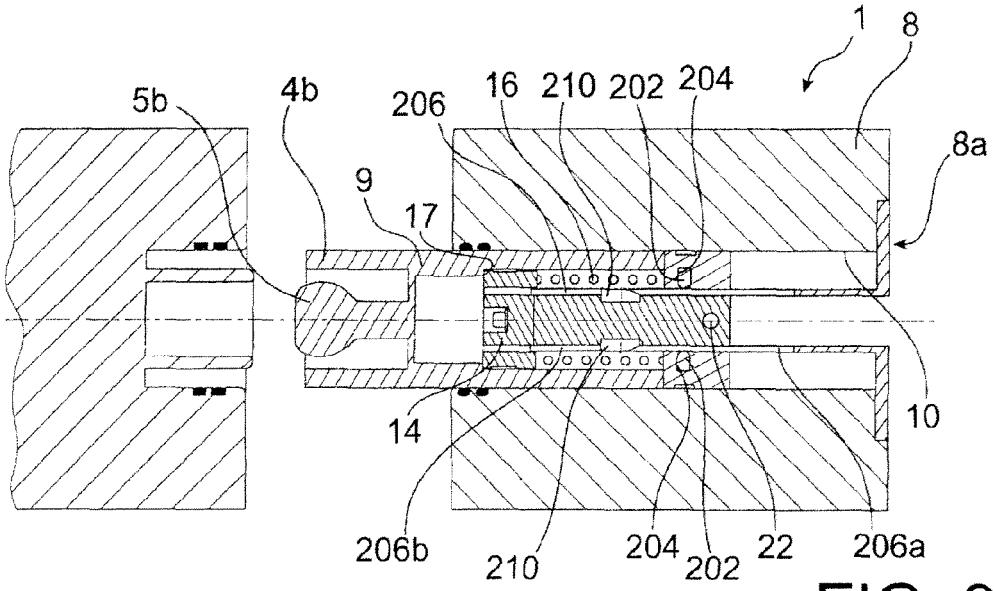
Figure 9E:
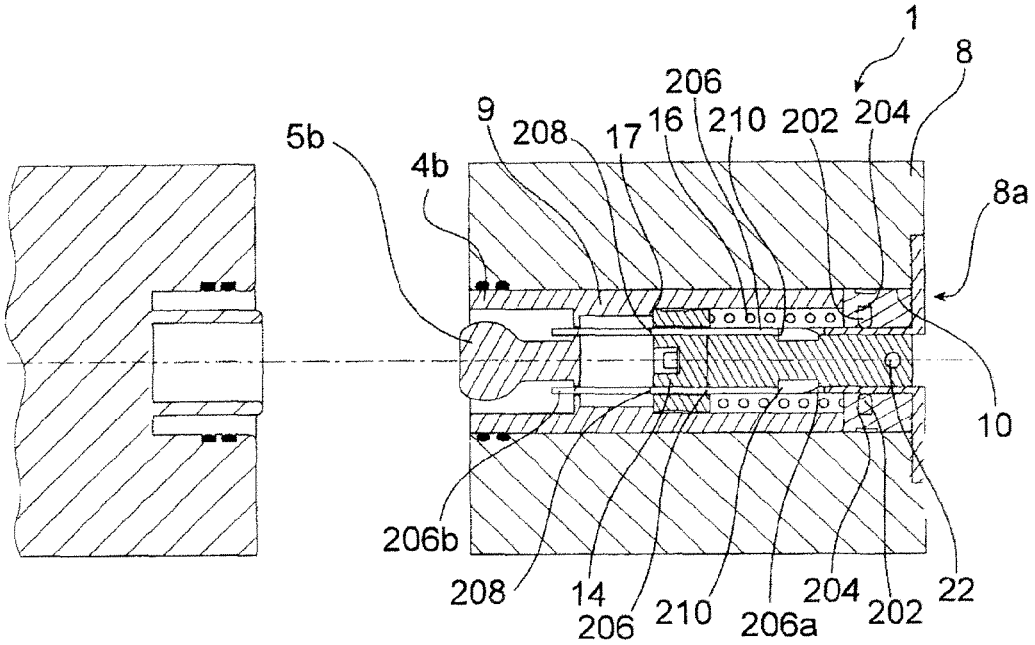
Figure 10:
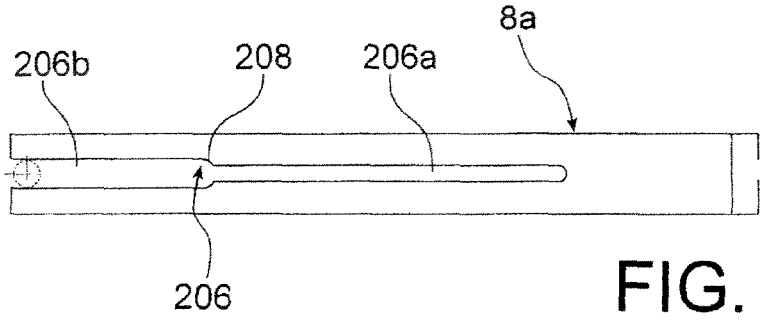
FIG. 10 shows the main body of the conductive unit of the disconnector shown in FIGS. 9*a* to 9*e*.

This same figure shows that the sliders 210 are designed to release the abutment means after the secondary body 14 has been moved relative to the main body 9 through a predetermined distance, at the end of which said sliders come into contact with the pins 202 and urge them radially outwards, opposing the return force exerted on said same pins. The stationary member 8*a* is thus released from the pins that are driven into the main body 8 under the effect of the sliders, and the spring 16 then decompresses suddenly and causes the main body 9 to accelerate, with the end wall of its bore 17 or a shoulder pressing against the secondary body 14, as shown in FIG. 9*d*. This acceleration is produced after separation of the main contacts and during separation of the arcing contacts, so as to limit electrical wear of said arcing contacts.

Then, opening takes place in a manner analogous to that described above, with the pins 202 pressing slidingly against the outer surface of the stationary member 8*a*, and the sliders 210 sliding in the narrowed portions 206*a* of the slots 206.

FIGS. 11*a* to 11*e* show a third example in which the abutment means 100 include a mechanical tulip 302 secured to the stationary body 8 and centered in the housing 10. The term "mechanical tulip" refers to a plurality of circumferentially distributed spring blades, each having an abutment forming rim at its end.

In addition, at its end opposite from the contacts 4*b*, 5*b* forming an integral part of the abutment means, the main body 9 presents longitudinal slots 306 in which an end of the secondary body 14 slides. This end forms unlocking means 210 for unlocking the abutment means, which unlocking means may be likened to sliders, each of which may be chamfered so as to soften entry into contact with the mechanical tulip.

In this example, the spring 16 is no longer a compression spring, but is a traction spring. It connects the end wall 17 of the bore 12 to the end wall of the secondary body 14. In addition, a stem 330 secured to the end wall 17 passes through an orifice of the end wall of the secondary body 14, and ends in an abutment 332.

FIGS. 11*a* to 11*e* correspond respectively to FIGS. 9*a* to 9*e* described above.

Thus, during initiation of the opening stage, the bodies 9 and 14 move together via the spring 16, and this results in the body 9 moving in the tulip 302.

Figure 11A:
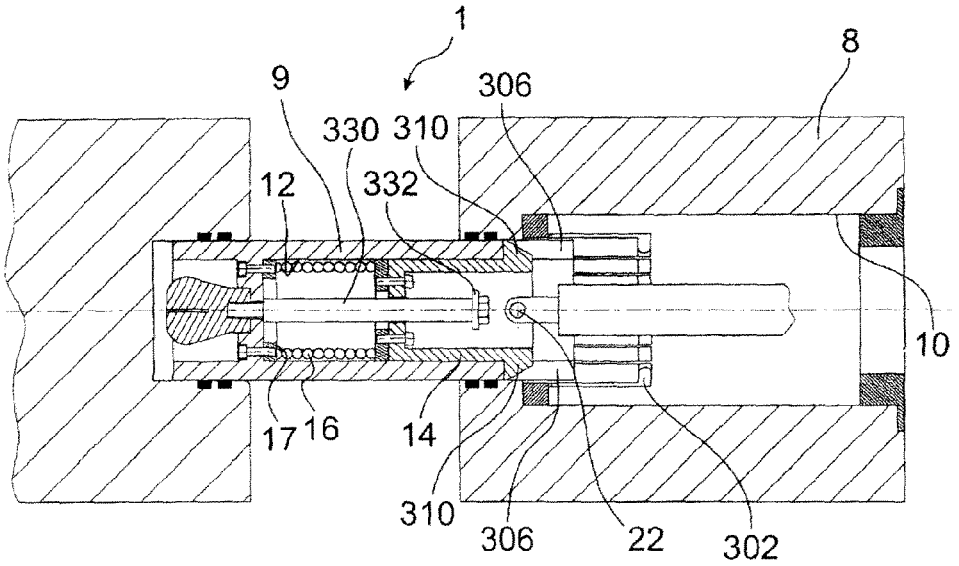
FIGS. 11*a* to 11*e* show different configurations the disconnector adopts successively during an opening operation, with the disconnector being in the form of another preferred embodiment of the invention.
Figure 11B:
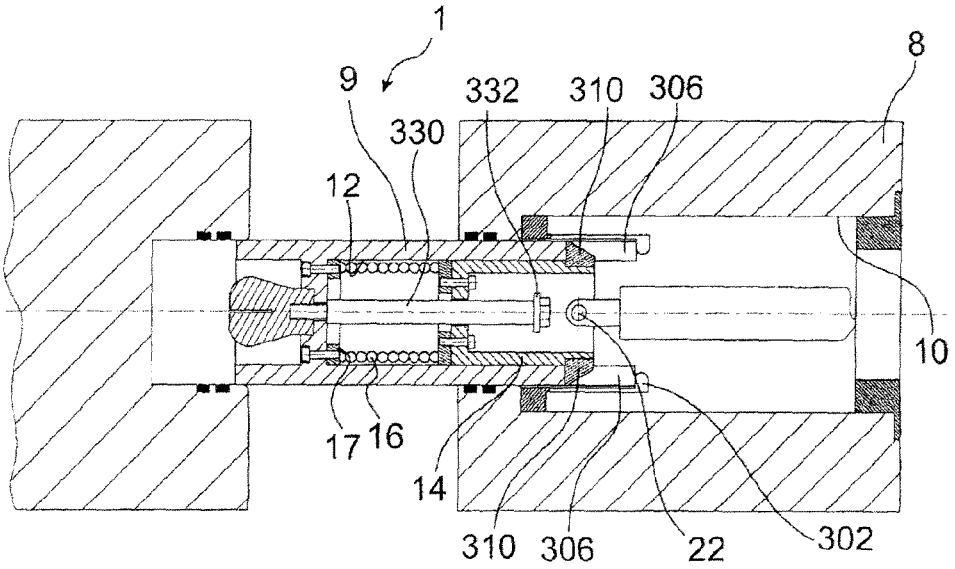

From an instant shown diagrammatically in FIG. 11*b*, the end of the main body 9 comes into abutment against the rims of the tulip 302, thus causing the abutment means to be activated. The main body 9 is thus stopped from moving in translation and is stationary relative to the body 8, whereas the secondary body 14 continues to be moved via its connection point 22. During this stage, the spring 16 is thus subjected to traction by the two bodies 9, 14 moving apart, which bodies move relative to one another, as shown diagrammatically in FIG. 11*c*. During said movement, the stem 330 slides through the dedicated orifice at the end wall of the secondary body 14.

Figure 11C:
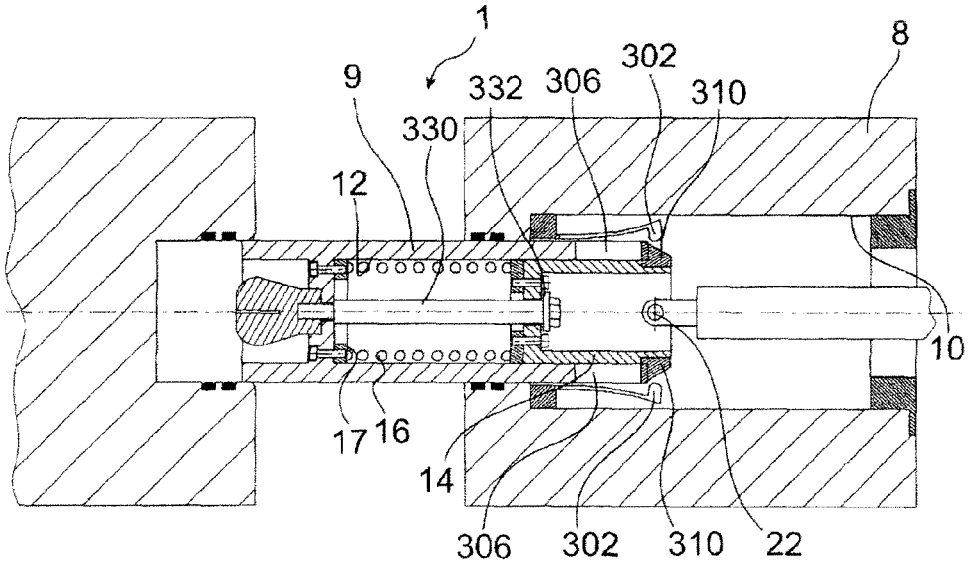
Figure 11D:
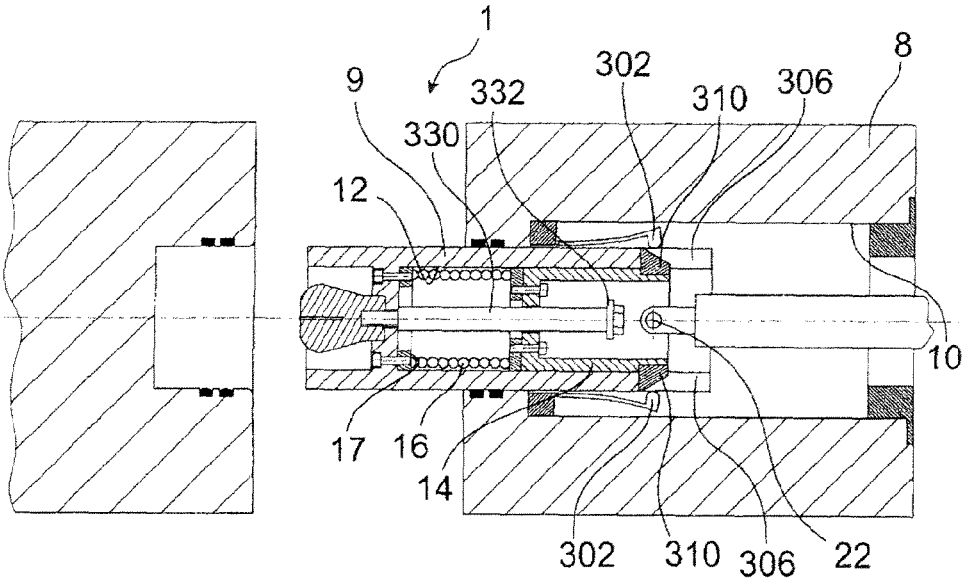
Figure 11E:
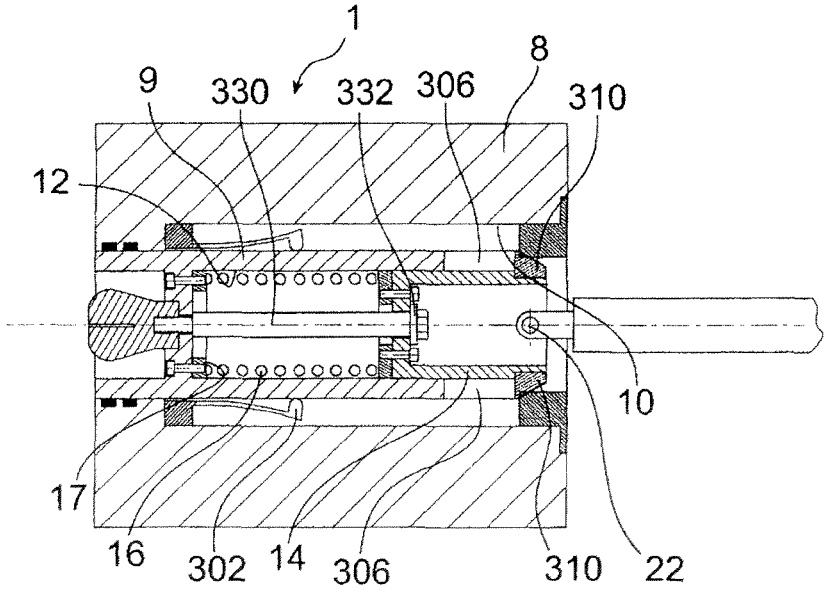

This same FIG. 11*c* shows that the sliders 310 are designed to release the abutment means after the secondary body 14 has been moved through a predetermined distance relative to the main body 9, at the end of which movement said sliders come into contact with the rims of the tulip 302 and urge them radially outwards, resiliently deforming the spring blades of said tulip. The main body 9 is thus released from the tulip that is deformed under the effect of the sliders, and the spring 16 then retracts suddenly causing the main body 9 to accelerate. The sliders 310 then return to their position in abutment in the ends of the slots 306, as shown in FIG. 11*d*. This acceleration is produced after separation of the main contacts and during separation of the arcing contacts, so as to limit electrical wear of said arcing contacts.

Then, opening takes place in a manner analogous to the manner described above, with the rims of the tulip pressing slidingly against the outer surface of the main body 9. Opening is stopped after the end of the main body has been put into abutment against the stationary body 8, and after the abutment of the stem 332 has been put into contact with the end wall of the secondary body 14, which leads to the spring 16 being tensioned. Thus, in this example, the contacts are certain to be brought into the open position, by means of the connection point 22, via the stem 330.

Naturally, various modifications may be made to the invention described above purely by way of non-limiting example by the person skilled in the art.

What is claimed is:

1. A switchgear comprising:

an electrically conductive movable unit (6) comprising an electrically conductive main body (9) including both a main contact (4*b*) and an arcing contact (5*b*);

wherein said electrically conductive movable unit (6) also comprises a secondary body (14) mounted to move in sliding relatively to said main body (9) along a movement direction (11) of said electrically conductive unit (6), said secondary body (14) being designed to be connected to a connection point (22) of a drive device of said electrically conductive unit (6), said electrically conductive unit further comprising resilient return means (16) interposed between said main body (9) and said secondary body (14), and said switchgear being designed so that during an opening operation said resilient return means (16) can firstly store energy as a result of the secondary body (14) moving relative to the main body (9), and can then release the stored energy in order to cause said main body (9) to accelerate, wherein the main contact (4*b*) and the arcing contact (5*b*) are fixed relative to one another in a sliding direction of the main body (9) during the opening operation when the secondary body (14) slides relative to the main body (9).

2. The switchgear according to claim 1, further including abutment means making it possible, during an opening operation, to block the movement in translation of said main body (9) relative to a stationary body (8) of the switchgear, and in that said secondary body (14) is fitted with unlocking means designed to release said abutment means after said secondary body (14) has been moved through a predetermined distance relative to the main body (9).

3. The switchgear according to claim 1, wherein said resilient return means (16) include at least one compression or traction spring.

4. The switchgear according to claim 2, wherein said abutment means are arranged on said stationary body (8) of the switchgear and on the main body (9) of the electrically conductive movable unit (6).

5. The switchgear according to claim 1, further comprising said drive device (30) for driving said electrically conductive movable unit (6), wherein the secondary body (14) is connected to the connection point (22) of said drive device (30).

6. The switchgear according to claim 5, wherein said drive device (30) comprises a rotary input shaft (32) and an output member (34) including a connection point (22) for connection to said electrically conductive unit (6), said connection point being movable in translation along a movement axis (11) of said electrically conductive unit, and in that the device (30) comprises a mechanical system (40) for transmitting movement between said connection point (22) and said rotary input shaft (32), said mechanical system being designed in such a manner, during an opening operation and/or during a closing operation of the switchgear, it obtains a variable speed for the connection point (22) during rotation at constant angular velocity of said rotary input shaft (32).

7. The switchgear according to claim 6, wherein said mechanical system (40) comprises at least two elements (44, 46), each provided with a groove (50, 56) and a peg-forming member (52, 58) housed to move in the groove of the other one of the two elements.

8. The switchgear according to claim 7, wherein the mechanical system (40) is designed so that either of the two elements (44, 46) is driven by the other element by pressing one of the peg-forming members (52, 58) into the bottom of its associated groove (50, 56), and by simultaneously moving the other peg-forming member in its associated groove.

9. A drive device according to claim 8, wherein the mechanical system (40) is designed so that during an opening operation and/or during a closing operation of the switchgear, each peg-forming member (52, 58) passes at least once from the configuration in which it presses into the bottom of its associated groove (50, 56) to the configuration in which it moves in its associated groove, or vice versa.

10. The switchgear according to claim 1, further including an electric motor (35) driving the rotary input shaft (32) of the drive device.

* * * * *